US005390930A

United States Patent [19]

Hu et al.

[11] Patent Number: 5,390,930

[45] Date of Patent: Feb. 21, 1995

[54] MAGNETICALLY RESTORED GOLF PRACTICE DEVICE

[76] Inventors: Chih-Chang Hu; Cha-Che Hu, both of c/o Hung Hsing Patent Service Center P.O. Box 55-1670, Taipei, Taiwan, Prov. of China

[21] Appl. No.: 233,689

[22] Filed: Apr. 26, 1994

[51] Int. Cl.[6] ..... A63B 69/36

[52] U.S. Cl. ..... 273/197 R

[58] Field of Search ..... 273/35 R, 184 R, 185 D, 273/195 R, 197 R, 196, 200 R, 200 B

[56] References Cited

U.S. PATENT DOCUMENTS

| | | | |
|---|---|---|---|
| 1,091,985 | 3/1914 | Thompson et al. | 273/197 R |
| 1,690,158 | 11/1928 | Currie | 273/197 R |
| 3,643,961 | 2/1972 | Schroeder | 273/197 R |
| 3,924,853 | 12/1975 | Schleeger | 273/200 B X |
| 4,741,536 | 5/1988 | Tai et al. | 273/197 R X |
| 4,852,883 | 8/1989 | Heselton et al. | 273/197 R |
| 4,955,612 | 9/1990 | Tai | 273/197 R X |

FOREIGN PATENT DOCUMENTS

| | | | |
|---|---|---|---|
| 706628 | 6/1931 | France | 273/197 R |
| 447316 | 5/1936 | United Kingdom | 273/197 R |

*Primary Examiner*—William E. Stoll

[57] ABSTRACT

A golf practice includes: a pivoting base fixed on a mat or a grass yard, a golf ball secured on a linking arm having a sleeve pivotally mounted on a shaft vertically erected on the pivoting base, two rotor magnets having opposite outer magnetic poles and diametrically secured on two opposite ends of the sleeve, and two stator magnets having opposite inner magnetic poles and respectively secured on two opposite ends of a hanging bracket fixed on a top portion of the shaft, with the two stator magnets diametrically aligned with the two rotor magnets fixed on the sleeve rotatably mounted on the shaft, each rotor magnet approximating each stator magnet by a rotation gap defined between the rotor magnet and the stator magnet, each rotor magnet having an outer magnetic pole facing an inner magnetic pole of each stator magnet with the outer magnetic pole of the rotor magnet having a polarity opposite to a polarity of the inner magnetic pole of the stator magnet for a mutual attraction between each rotor magnet and each stator magnet, whereby upon striking of the ball by a club for rotating the ball, the ball will be stopped at its starting position as automatically restored by the magnetic force acting between each stator magnet and each rotor magnet.

7 Claims, 5 Drawing Sheets

MAGNETICALLY RESTORED GOLF PRACTICE DEVICE

BACKGROUND OF THE INVENTION

Before really attending a golf course for playing golf, the golf beginner or player may practice golf at his or her home either indoors or outdoors, by practicing the skills such as putting, chipping, pitching and swing on a mat, or a mown grass yard. A golf ball may be secured on a rotating arm which is pivotally mounted on a shaft vertically erected on a base, whereby upon striking of the ball as hit by a golf club, the ball and its connected arm will be free rotated and stopped at uncertain locations, thereby requiring a "re-set" positioning of the ball at its starting point (teeing position) for each shot by the club and thereby causing inconvenience for the player.

SUMMARY OF THE INVENTION

The object of the present invention is to provide a golf practice device including: a base fixed on a mat or a grass yard, a golf ball secured on a linking arm having a sleeve pivotally mounted on a shaft vertically erected on the base, two rotor magnets having opposite outer magnetic poles and diametrically secured on two opposite ends of the sleeve, and two stator magnets having opposite inner magnetic poles and respectively secured on two opposite ends of a hanging bracket fixed on a top portion of the shaft, with the two stator magnets diametrically aligned with the two rotor magnets fixed on the sleeve rotatably mounted on the shaft, each rotor magnet approximating each stator magnet by a rotation gap defined between the rotor magnet and the stator magnet, each rotor magnet having an outer magnetic pole facing an inner magnetic pole of each stator magnet with the outer magnetic pole of the rotor magnet having a polarity opposite to a polarity of the inner magnetic pole of the stator magnet for a mutual attraction between each rotor magnet and each stator magnet, whereby upon striking of the ball by a club for rotating the ball, the ball will be stopped at its starting position as automatically restored by the magnetic force acting between each stator magnet and each rotor magnet.

DETAILED DESCRIPTION

Figure 1:
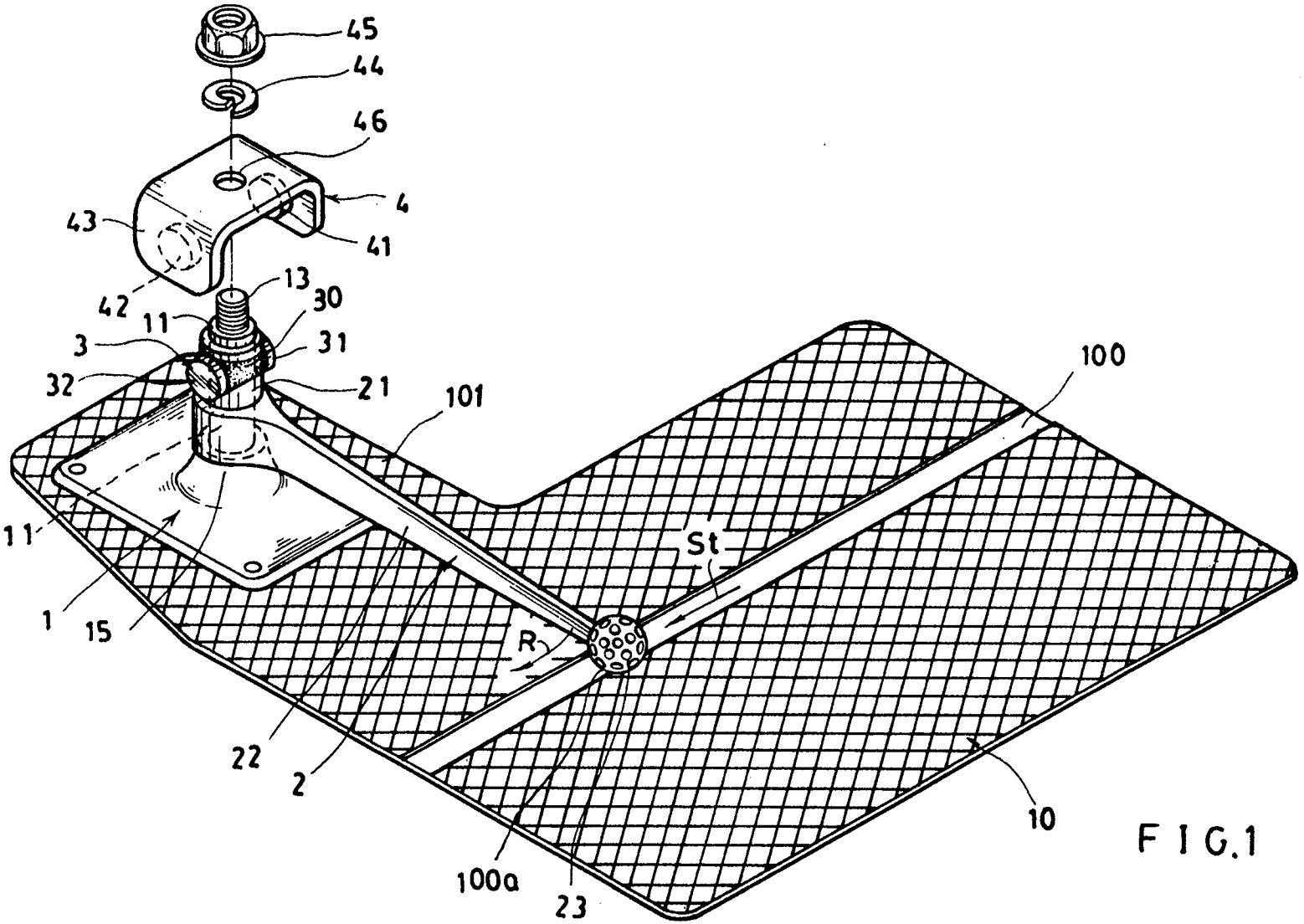
FIG. 1 is a perspective view of the present invention.

As shown in FIGS. 1–4, the present invention comprises; a base 1 laid on a supporting surface such as a mat 10 or grass yard 10*a* (FIG. 6), a ball means 2, a rotor magnet means 3 and a stator magnet means 4. The base

Figure 2:
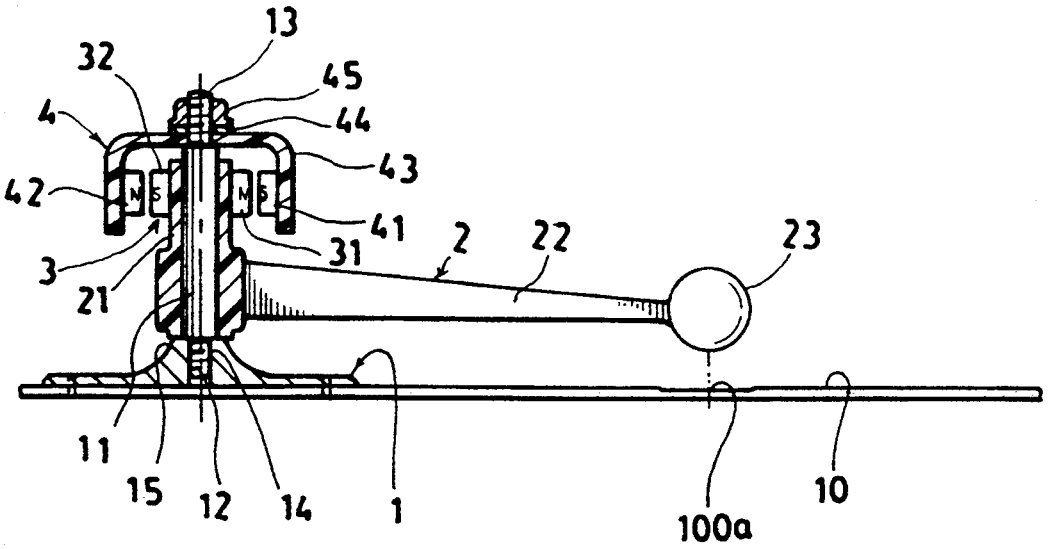
FIG. 2 is a sectional drawing of the present invention when assembled.

1 may be combinably fixed on a mat 10 as shown in FIGS. 1, 2.

The base 1 includes: a shaft 11 having a lower male-threaded portion 12 formed on a lower portion of the shaft 11 and having an upper male-threaded portion 13 formed on an upper portion of the shaft 11, and a base block 15 having a female-threaded hole 14 vertically formed in the base block 15 for engaging the lower male-threaded portion 12 of the shaft 11 for vertically securing the shaft 11 on the base block 15.

The base 1 may be secured on a area 101 of a mat 10 having a target line 100 longitudinally formed or marked on the mat 10 for aiming a target of a golf ball 23 of the ball means 2, and a starting point 100*a* marked on the target line 100 for serving as a teeing position of a golf game.

The ball means 2 includes: a sleeve 21 rotatably engageable with the shaft 11 of the base 1, a linking arm 22 having its one end secured to the sleeve 21 and having its another end secured with a golf ball 23. The ball 23 is previously positioned at a starting point 100*a* marked on the target line 100 on the mat 10 when the rotor magnet means 3 is magnetically coupled to the stator magnet means 4.

The rotor magnet means 3 includes: a first rotor magnet 31 and a second rotor magnet 32 diametrically disposed on and respectively secured to two opposite end portions of the sleeve 21 of the ball means 2 by adhesive 30, with the first rotor magnet 31 having an outer magnetic pole (such as N pole) opposite in polarity to an outer magnetic pole (such as S pole) of the second rotor magnet 32.

The stator magnet means 4 is disposed around said rotor magnet means 3 by a gap between the two magnet means 4, 3 and includes: a first stator magnet 41 and a second stator magnet 42 respectively fixed on two opposite end portions of a hanging bracket 43 generally inversed U-shaped, having a shaft hole 46 formed through a central portion of the bracket 43 which is secured to the upper male-threaded portion 13 of the shaft 11 of the base 1 by a washer 44 and a nut 45, and with the first stator magnet 41 having an inner magnetic pole (such as S pole) facing to and opposite in polarity to an outer magnetic pole (such as N pole) of the first rotor magnet 31 and having the inner magnetic pole (such as S pole) of the first stator magnet 41 opposite in polarity to an inner magnetic pole (such as N pole) of the second stator magnet 42.

Figure 4:
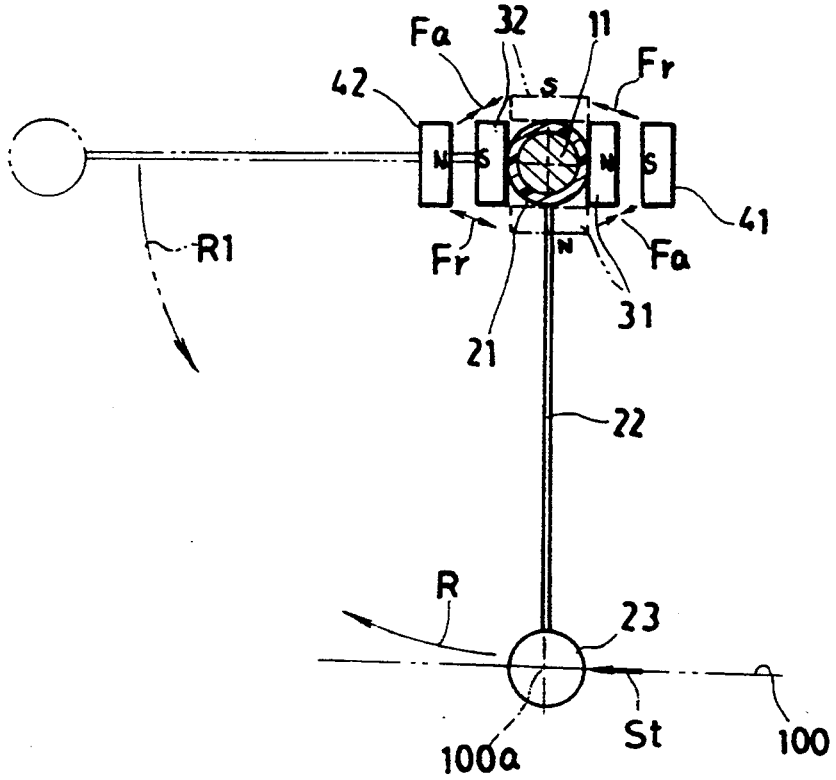
FIG. 4 is an illustration showing a magnetically restoring operation in accordance with the present invention.

When hitting (St) the ball 23 by a golf club (not shown) for simulating a golf stroke or a shot such as a swinging or a putting movement, the ball 23 with its arm 22 will be rotated (R) in several turns about the shaft 11 of the means 1 and when the ball 23 and its link 22 is finally stopped as deviated from its starting point 100*a* as shown in dotted line of FIG. 4, the magnetically attractive force Fa between the opposite poles of the stator magnet and the rotor magnet as well as the magnetically repulsive force Fr between the same poles of the stator magnet and the rotor magnet will automatically restore (R1) the sleeve 21, the arm 22 and the ball 23 to its original starting point 100*a*, thereby eliminating a "re-set" positioning operation of the ball 23 to its starting point after each stroke of the ball 23.

Figure 3:
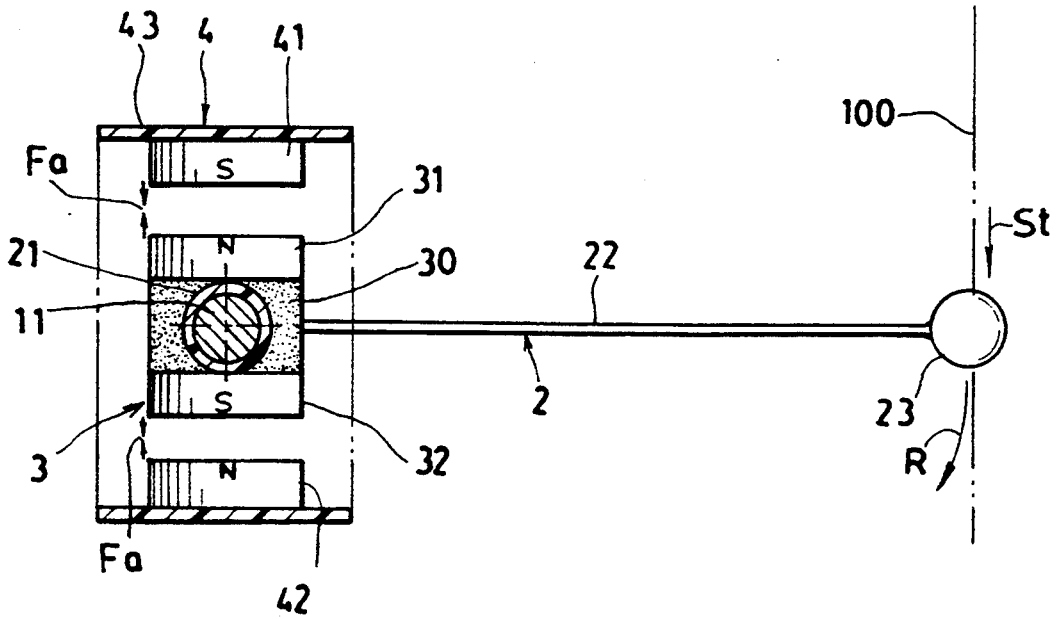
FIG. 3 is a cross sectional illustration showing a relationship between the stator magnet and the rotor magnet of the present invention.

In positioning the ball 23 at its starting point 100*a*, the ball 23 can be first moved to projectively match the location of the starting point 100*a* by adjustably moving the linking arm 22. Then, the bracket 43 secured with the two stator magnets 41, 42 will be rotated until being diametrically aligned with the two rotor magnets 31, 32 as shown in FIG. 3, for example, for ensuring a magnetic attraction (Fa) between each stator magnet 41 or 42 with each rotor magnet 31 or 32. Finally, the washer 44 and nut 45 are then fixed on the upper portion 13 of the shaft 11 for stably locking the bracket 43 on the shaft 11 for correspondingly approximating each stator magnet 41 or 42 to each rotor magnet 31 or 32.

Figure 5:
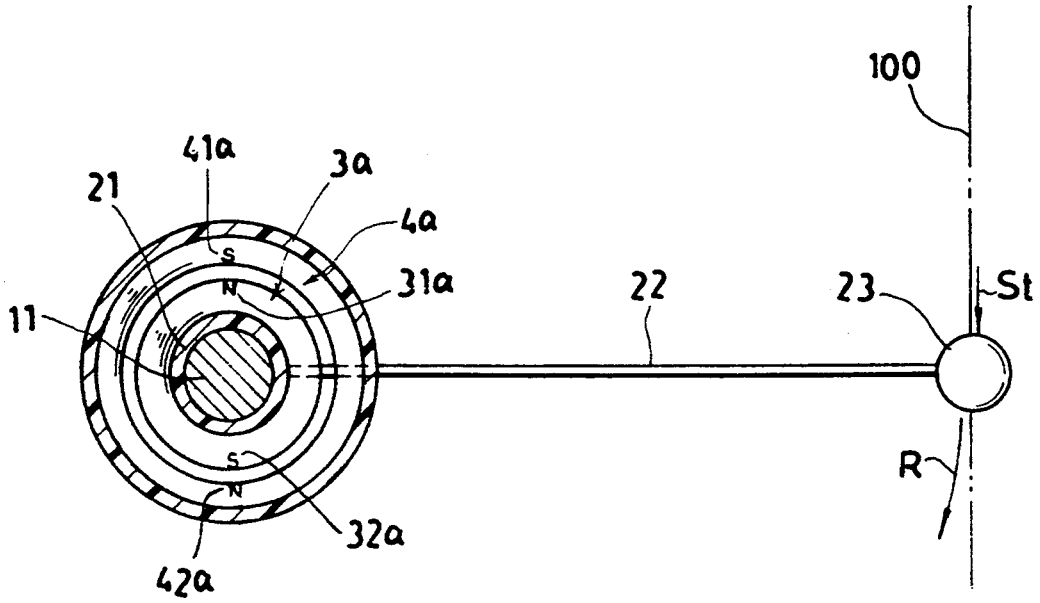
FIG. 5 is a cross sectional drawing of another preferred embodiment of the stator and rotor magnet of the present invention.

As shown in FIG. 5, the aforementioned rotor magnet means 3 having the first and second rotor magnets 31, 32 may be modified to be a cylindrical rotor magnet 3*a* having two outer magnetic poles (N, S) opposite in polarity with each other; and the two stator magnets 41, 42 have been modified to be an annular stator magnet 4*a* having two inner magnetic poles 41*a*, 42*a* (S, N) opposite in polarity with each other, with each inner magnetic pole 41*a* or 42*a* of the annular stator magnet 4*a* being opposite in polarity to each corresponding outer magnetic pole 31*a* or 32*a* of the cylindrical rotor magnet 3*a*.

Figure 6:
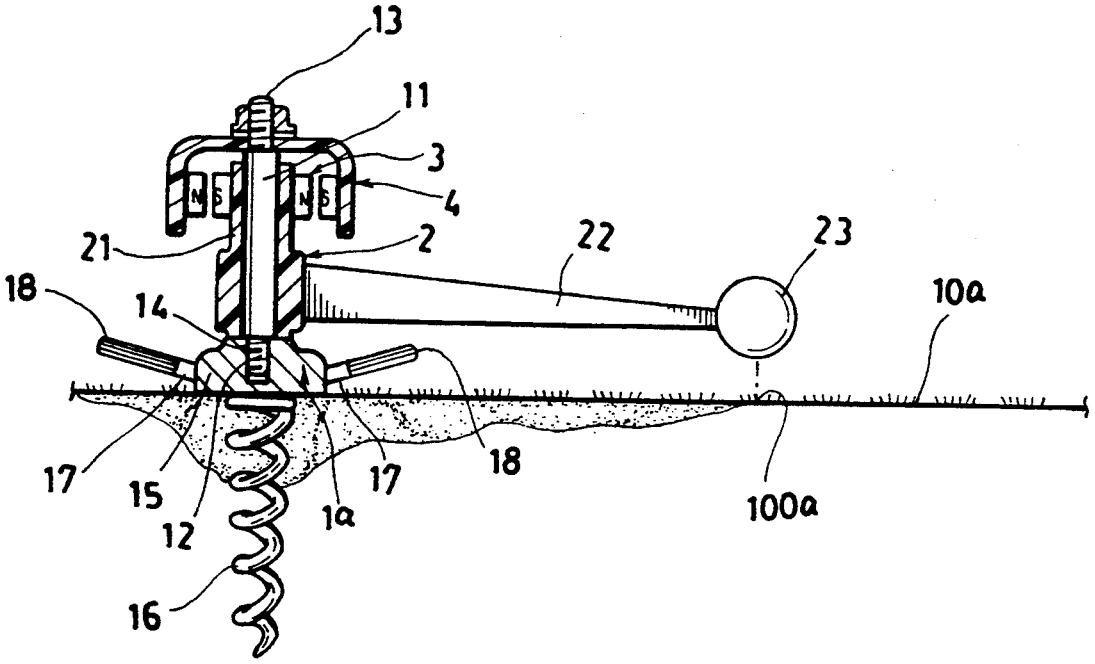
FIG. 6 is a sectional drawing of another preferred embodiment of the present invention.

The base block 15 of the base 1 may further include a fixing bolt 16 which may be a screw or a spiral coil protruding downwardly from the base block 15 to be stably dug into a grass yard 10*a* as shown in FIG. 6, two shoulder connectors 17 protruding rightwardly and leftwardly from the block 15, and two driving handles 18 detachably secured on the two shoulder connectors 17 for forcibly driving the handles 18 in order to rotate the fixing bolt 16 downwardly into a ground of the grass yard 10*a* for stably fixing the base 1 by omitting the aforementioned mat 10 as shown in FIG. 1. The handles 18 can then be dismantled from the connectors 17.

The present invention can automatically restore the ball 23 to its original starting point 100*a*, thereby saving a re-set operation for re-positioning the ball to its starting point, and for enhancing a very convenient indoor or outdoor golf hitting practice.

Figure 7:
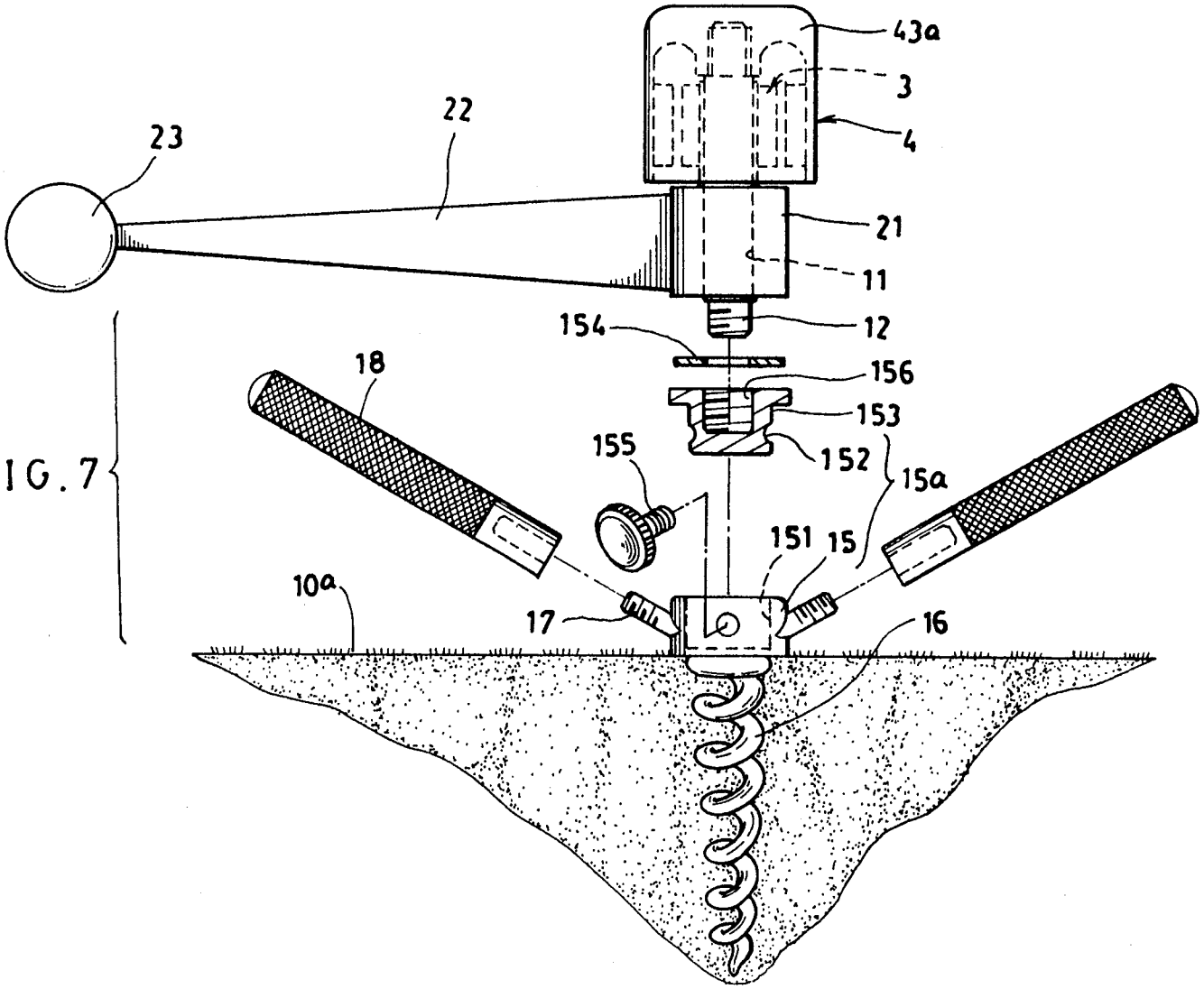
FIG. 7 shows another preferred embodiment of the present invention as modified from FIG. 6.

The present invention may be further modified without departing from the spirit and scope of this invention. As shown in FIG. 7, an adapter 15*a* is provided on the base block 15, which includes: a socket 151 recessed downwardly in the block 15, a coupling 153 insertable in the socket 151 and having an annular groove 152 circumferentially recessed in the coupling 153, a screw 155 held in the block 15 for locking the coupling 153 in the socket 151 of the block 15 by engaging a screw tip of the screw 155 with the annular groove 152 of the coupling 153, and having a female-threaded hole 156 formed in an upper portion of the coupling 153 for connecting the lower male-threaded portion 12 of the shaft 11 by a washer 154 for rotatably mounting the ball means 2 on the shaft 11 of the pivoting means 1*a*. The hanging bracket 43 may also be modified to be a cap 43*a* for fixing the stator magnets 41, 42 therein.

We claim:

1. A golf practice device comprising: a base (1) having a shaft (11) vertically erected on said base when said base is laid on a supporting surface; a ball means (2) including a sleeve (21) rotatably mounted on said shaft (11), a linking arm (22) having a first end of said arm secured on said sleeve (21) and having a second end of said arm fixed with a golf ball (23) thereon; a rotor magnet means (3) secured on said sleeve (21) of said ball means (2) having at least two outer magnetic poles having opposite polarities with each other and diametrically disposed on two opposite end portions of said sleeve (21); and a stator magnet means (4) secured on said base (1) and having at least two inner magnetic poles having opposite polarities with each other and diametrically disposed on two opposite sides of a bracket (43), with each said inner magnetic pole of said stator magnet means (4) being opposite in polarity to and approximately facing each said outer magnetic pole of said rotor magnet means (3), said rotor magnet means (3) operatively rotatable within said stator magnet means (4) and magnetically attracting said stator magnet means (4) to normally position said ball (23) on a starting point (100*a*) on the supporting surface, whereby upon striking on said ball (23) to rotate said ball (23), said arm (22) and said sleeve (21) will rotate about said shaft (11) and when the ball connected with said arm is stopped after the rotation, the ball will be automatically restored to the starting point due to magnetic attraction between said rotor magnet means (3) and said stator magnet means (4).

2. A golf practice device according to claim 1, wherein said base (1) includes: said shaft (11) having a lower male-threaded portion (12) formed on a lower portion of the shaft (11) and having an upper male-threaded portion (13) formed on an upper portion of the shaft (11), and a base block (15) having a female-threaded hole (14) vertically formed in the base block (15) for engaging the lower male-threaded portion (12) of the shaft (11) for vertically securing the shaft (11) on the base block (15).

3. A golf practice device according to claim 2, wherein said base (1) is secured on a pivoting area (101) of a mat (10) having a target line (100) longitudinally formed on the mat (10) for aiming a target of a golf ball (23) of the ball means (2), and a starting point (100*a*) marked on the target line (100) serving as a teeing position of a golf game.

4. A golf practice device according to claim 2, wherein said base block (15) of the base (1) includes a fixing bolt (16) protruding downwardly from the base block (15) to be stably dug and held into a ground of a grass yard, two shoulder connectors (17) protruding rightwardly and leftwardly from the block (15), and two driving handles (18) detachably secured on the two shoulder connectors (17) for forcibly driving the handles (18) in order to rotate the fixing bolt (16) downwardly into the ground for stably fixing the base (1) therein.

5. A golf practice device according to claim 1, wherein said rotor magnet means (3) disposed within said stator magnet means (4) includes: a first rotor magnet (31) and a second rotor magnet (32) diametrically disposed on and respectively secured to two opposite end portions of the sleeve (21) of the ball means (2), with the first rotor magnet (31) having an outer magnetic pole thereof opposite in polarity to the other outer magnetic pole of the second rotor magnet (32).

6. A golf practice device according to claim 5, wherein said stator magnet means (4) includes: a first stator magnet (41) and a second stator magnet (42) respectively fixed on two opposite end portions of a hanging bracket (43), having a shaft hole (46) formed in a central portion of the bracket (43) which is secured to the upper male-threaded portion (13) of the shaft (11) of the base (1), and with the first stator magnet (41) having an inner magnetic pole facing towards and opposite in polarity to an outer magnetic pole of the first rotor magnet (31) of said rotor magnet means (3) and having the inner magnetic pole of the first stator magnet (41) opposite in polarity to the other inner magnetic pole of the second stator magnet (42).

7. A golf practice device according to claim 1, wherein said rotor magnet means is a cylindrical rotor magnet (3*a*) secured on said sleeve (21) of said ball means (2) and said stator magnet means is an annular stator magnet (4*a*) disposed around said cylindrical rotor magnet (3*a*).

* * * * *